US010655914B2

(12) United States Patent
Seehausen, Jr.

(10) Patent No.: US 10,655,914 B2
(45) Date of Patent: May 19, 2020

(54) PORTABLE MODULAR DRYER DEVICE

(71) Applicant: Robert Howard Seehausen, Jr., Lewisville, NC (US)

(72) Inventor: Robert Howard Seehausen, Jr., Lewisville, NC (US)

( * ) Notice: Subject to any disclaimer, the term of this patent is extended or adjusted under 35 U.S.C. 154(b) by 174 days.

(21) Appl. No.: 15/437,066

(22) Filed: Feb. 20, 2017

(65) Prior Publication Data

US 2017/0241711 A1 Aug. 24, 2017

Related U.S. Application Data

(60) Provisional application No. 62/297,449, filed on Feb. 19, 2016.

(51) Int. Cl.

| | |
|---|---|
| ***F26B 7/00*** | (2006.01) |
| ***F26B 21/00*** | (2006.01) |
| ***A47L 23/20*** | (2006.01) |
| ***D06F 59/02*** | (2006.01) |
| ***A45D 20/12*** | (2006.01) |
| ***F26B 9/00*** | (2006.01) |
| *D06F 59/04* | (2006.01) |

(52) U.S. Cl.

CPC ..... *F26B 21/006* (2013.01); *A45D 20/122* (2013.01); *A47L 23/205* (2013.01); *D06F 59/02* (2013.01); *F26B 9/003* (2013.01); *A45D 20/12* (2013.01); *D06F 59/04* (2013.01)

(58) Field of Classification Search

CPC ..... A47L 23/205; F16L 47/28; F16L 47/06; F16L 25/14

See application file for complete search history.

(56) References Cited

U.S. PATENT DOCUMENTS

| | | | | |
|---|---|---|---|---|
| 4,171,580 | A | 10/1979 | Vabrinskas | |
| 4,967,060 | A * | 10/1990 | Lomeli | A47L 23/205 239/391 |
| 5,222,308 | A * | 6/1993 | Barker | A47L 23/205 34/104 |
| 5,289,642 | A | 3/1994 | Sloan | |
| 7,389,596 | B2 | 6/2008 | Parks | |
| 2013/0326898 | A1* | 12/2013 | Quessard | A45D 20/12 34/97 |
| 2015/0037015 | A1* | 2/2015 | Lee | A45D 20/12 392/384 |

* cited by examiner

*Primary Examiner* — Jason Lau
(74) *Attorney, Agent, or Firm* — Clements Bernard Walker Law

(57) ABSTRACT

The present invention provides methods and systems for a portable modular drying device that includes a distributing manifold for receiving a blower device that distributes air through the device, and at least one drying manifold having a first end, a second end, and at least one opening between the first end and the second end for distributing the drying air selectively secured to the distributing manifold. The device further includes at least one drying hose or glove tube selectively secured to the at least one opening of the at least one drying manifold.

15 Claims, 7 Drawing Sheets

PORTABLE MODULAR DRYER DEVICE

CROSS REFERENCE TO RELATED PATENT APPLICATION

The present patent application/patent claims the benefit of priority of U.S. Provisional Patent Application No. 62/297,449, filed on Feb. 19, 2016, and entitled "PORTABLE MODULAR DRYER DEVICE," the contents of which are incorporated in full by reference herein.

FIELD OF THE INVENTION

The present invention relates generally to a device for drying athletic and occupational articles, and more generally relates to a portable, modular dryer, that can be included in a kit and easily assembled therefrom, for drying a plurality of boots, gloves, hats and the like in a number of configurations to allow for different spatial requirements and numerous variations of articles for drying.

BACKGROUND OF THE INVENTION

Various devices have been patented for the purpose of drying boots and other articles of clothing. To reduce the disadvantages of prior art boot drying structures, typically of a bulky, non-portable and limiting construction, the immediate invention attends to the deficiencies thereof not only by providing a compact and efficient structure, but further includes a design facilitating ease of transport, expansion and configuration to meet limited space requirements to accommodate a greater number of boot pairs and other articles of clothing to be dried. The prior structures can only accommodate one or two pairs of boots or gloves. The design and structure of the immediate invention can accommodate numerous pairs of boots and/or gloves and facilitates packing and transport based upon its portable and modular design, allowing the invention to be easily and efficiently packed into luggage for vacations or transported for another purpose. The instant invention further attends to deficiencies of the prior art thereof by providing a design facilitating ease of deconstruction and storage when not in use.

U.S. Pat. No. 5,289,642 discloses a portable dryer for drying the interior of ski boots, ski gloves, etc. The device includes articulated tubing for insertion into the toe portion of a ski boot. At the other end of the articulated tubing is a distribution connector for connecting a means of forcing air through the tubing and into the interior of the ski boot for drying purposes.

U.S. Pat. No. 4,171,580 discloses a boot dryer with a housing having an ingress port and an egress port with a motor driven fan therein. A pair of flexible hoses are secured to the ports of the housing and extend downwardly therefrom when the housing is supported by a wire-like hook pivotably secured to the uppermost regions of the housing. The hoses are inserted into a pair of boots and a slow cool flow of air enters one boot and circulates upwardly through one hose and through the housing and then downwardly through the other hose.

U.S. Pat. No. 7,389,596 discloses a show drying rack that fits within a dryer's drum. The rack comprises an open container divided into two mirror imaged halves joined together by an adjustable connector arm that can be a telescopic arm. A strap and holding posts are located in each halve for keeping one or more pairs of shoes in place during drying.

Accordingly, there remains a need for a new and improved boot drying apparatus as set forth by the instant invention which addresses the problems of ease of use, effectiveness in construction, modular, as well as the portable nature of the device and in this respect, the present invention considerably fills this need and allows for a plurality of gloves and boots to be dried simultaneously and/or a combination of boots and gloves to be dried simultaneously.

BRIEF SUMMARY OF THE INVENTION

According to an embodiment of the present invention, a portable modular drying device that includes a distributing manifold for receiving a blower device that distributes air through the device, and at least one drying manifold having a first end, a second end, and at least one opening between the first end and the second end for distributing the drying air and selectively secured to the distributing manifold. The device further includes at least one drying hose selectively secured to the at least one opening of the at least one drying manifold.

According to another embodiment of the present invention, a portable modular drying device that includes an end cap selectively secured to the second end of the least one drying manifold.

According to yet another embodiment of the present invention, a portable modular drying device that includes at least one hose adaptor selectively secured to the at least one opening of the at least one drying manifold and the at least one drying hose.

According to yet another embodiment of the present invention, a kit for drying an article of clothing that includes a distributing manifold, at least one drying manifold, at least one hose adaptor, and at least one end cap.

According to yet another embodiment of the present invention, a kit for drying an article of clothing that includes a blower nozzle.

According to yet another embodiment of the present invention, a kit for drying an article of clothing that includes a blower device.

According to yet another embodiment of the present invention, a kit for drying an article of clothing that includes at least one hose adaptor.

According to yet another embodiment of the present invention, a kit for drying an article of clothing that includes at least one drying conduit.

According to yet another embodiment of the present invention, a method for drying an article of clothing that includes providing a blower nozzle, a distributing manifold for receiving a blower device that distributes air through the device, at least one drying manifold having a first end, a second end, and at least one opening between the first end and second end for distributing the drying air and selectively secured to the distributing manifold, and at least one drying hose selectively secured to the at least one opening of the at least one drying manifold. A blower device is attached to the blower nozzle, and drying air is blown from the blower device into the blower nozzle. An article of clothing is attached to the at least one drying hose for drying the article of clothing.

According to yet another embodiment of the present invention, a method for drying an article of clothing that includes providing a hose adaptor for selective securement between the drying manifold and drying hose.

According to yet another embodiment of the present invention, a method for drying an article of clothing that includes providing at least one drying conduit.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
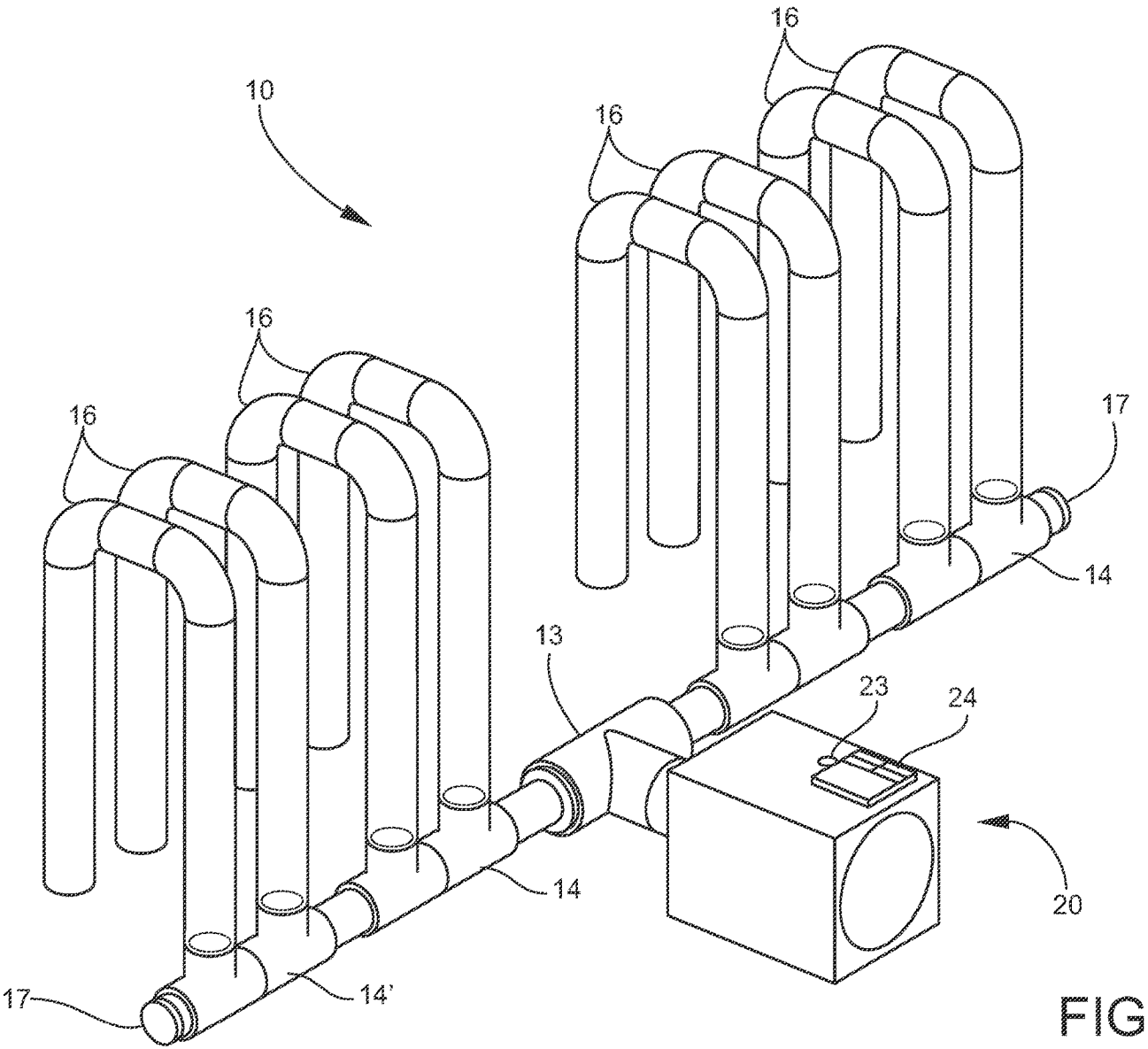
FIG. 1 is a perspective view of the portable modular dryer device.
Figure 2:
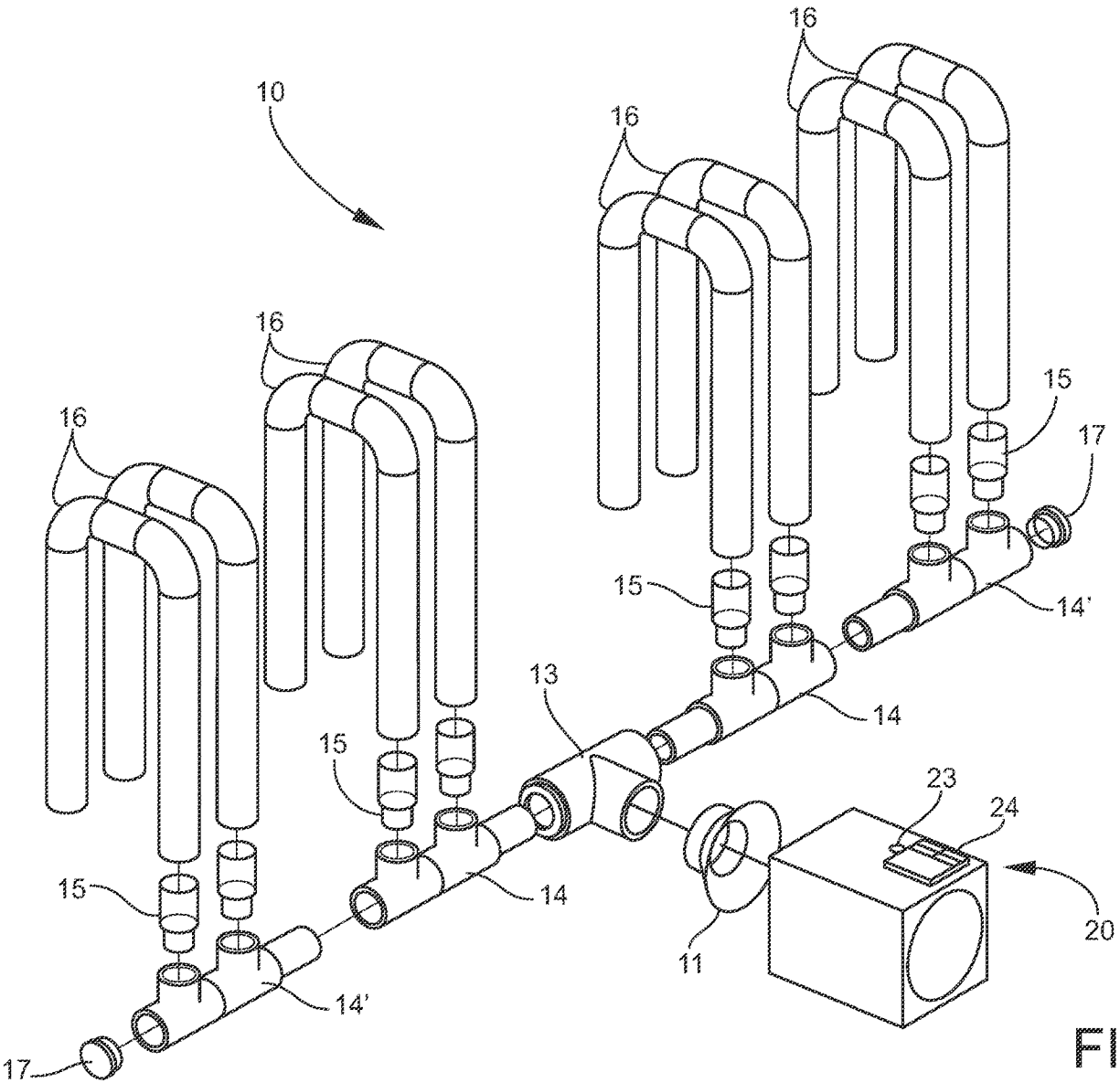
FIG. 2 is an exploded view of the portable modular drying device as shown in FIG. 1.

Referring now specifically to the drawings, a portable modular dryer device is illustrated in FIG. 1 and is shown generally at reference numeral 10. The portable modular dryer device 10 generally comprises a distributing manifold 13, at least one drying manifold 14, and at least one drying hose 16 selectively secured to the at least one drying manifold 14. As illustrated in FIGS. 1 and 2, a blower device 20 is engaged to a blower nozzle 11 intersecting in fluid flow communication with the distributing manifold 13. The blower device 20 forces drying air through the entire device 10. The blower nozzle 11 includes a conduit entrance disposed on a first side and accepting the forced drying air flow from the blower unit 20, employing either heated or non-heated drying air flow directed into the conduit entrance.

The second end of the blower nozzle 11 intersects the distributing manifold 13, allowing the drying air to flow from the blower device 20 and from the first side to the second side of the distributing manifold 13. As shown in FIGS. 1 and 2, the distributing manifold 13 has a first portion and a second portion and is generally t-shaped with a single inlet and two exits. The distributing manifold 13 is generally hollow for allowing the passage of air unobstructed and has an inner surface and an outer surface. The inlet, first exit, and second exit are generally circular, but may have any shape that corresponds to the components intended to be mounted thereto. The first portion has a generally circular outer surface and inner surface that intersects the second portion, preferably at a central point along the second portion. The second portion of the distributing manifold 13 also has a generally circular outer surface and inner surface. Although a generally circular first portion and second portion of the distributing manifold 13 is illustrated and described herein, the distributing manifold 13 may have other shapes such as generally rectangular, generally square, generally oval, and the like.

The drying air proceeds through the inlet and proceeds through the inner surface of the first portion. At the point where the air exits the first portion and enters the second portion, the air proceeds along the inner portion of the second portion and exits the first exit and second exit located on either end of the second portion. The inlet of the distributing manifold 13 is engaged to the second end of the blower nozzle 11. As will be noted, the second end of the blower nozzle 11 is generally circular and received within the generally circular inlet of the distributing manifold 13. The diameter of the inlet of the distributing manifold 13 is slightly larger than the diameter of the second end of the blower nozzle 11, allowing the second end of the blower nozzle 11 to matingly slide within the inlet of the distributing manifold. The distributing manifold 13 is selectively secured to the blower nozzle 11 by friction fit or the locking mechanism described below.

The exits of the distributing manifold 13 are engaged to a drying manifold 14 with a drying manifold 14 disposed on either side of the distributing manifold 13 and air flows from the distributing manifold 13 to the drying manifolds 14.

The drying manifold 14 is generally hollow and comprises a first end, a second end, and at least one opening disposed between the first end and the second end and an outer surface and inner surface. The drying manifold is generally t-shaped, where the first end and the second end are disposed on opposite ends of the first portion. As illustrated in FIGS. 1 and 2, the drying manifold 14 has two spaced-apart openings disposed between the first end and second end. As illustrated, the drying manifold 14 has a first portion, a second portion, and a third portion. The first end and second end are contained on the first portion, and the first opening is contained on the second portion, and the second opening is contained on the third portion. The second portion and third portion consists of an elongate hollow tube that extends upwardly from the first portion. As illustrated, the second portion and third portion extend at an angle of about 90 degrees from the first portion. An opening is contained on the end of the second portion and the third portion for allowing a portion of the air traveling through the first end to exit openings on the second portion and third portion.

The first end of the drying manifold 14 may be selectively secured to either the first exit or second exit of the distributing manifold 13 by friction fit or the locking mechanism described below for allowing the drying air exiting the distributing manifold 13 to proceed through the drying manifold 14. As illustrated, the first end, second end, and at least one opening are generally circular in shape. The first end of the drying manifold 14 has a diameter slightly smaller than the diameter of the first or second exit of the distributing manifold 13 of which it is connected. As illustrated in FIGS. 1 and 2, the first end of the drying manifold 14 that engages first or second exit of the distributing manifold 13, wherein the first end has a diameter that is slightly smaller than that of the diameter of the rest of the first portion. This embodiment allows the first end to engage the distributing manifold 13, but also the second end of an adjacent drying manifold 14. Although a generally circular first end, second end, and openings of the drying manifold 14 are illustrated and described herein, the drying manifold 14 may have other shapes such as generally rectangular, generally square, generally oval, and the like.

As illustrated in FIG. 2, a hose adaptor 15 may be engaged to opening or openings of the drying manifold 14, wherein the drying air proceeding through the drying manifold 14 is fed into the hose adaptor 15. A second end of the hose adaptor 15 is engaged to the drying manifold 14 and a drying hose 16 is engaged to the first end of the hose adaptor 15. The hose adaptor 15 is hollow and generally circular in shape. The first end of the hose adaptor 15 has a larger diameter than the second end. The second end of the hose adapter 15 is received within an opening of the drying manifold 14, as illustrated in FIG. 2.

The drying hose 16, illustrated in FIGS. 1 and 2, illustrates a hose for drying a boot, shoe, or the like. The drying hose 16 is substantially u-shaped with the distal end intended to be inserted into the toe of a boot, shoe, or the like. As the drying air is fed into the hose adaptor 15 from the drying manifold, the drying air proceeds through the hose adaptor 15 and into the drying hose 16. The proximal end of the drying hose 16 is engaged to the second end of the hose adaptor 15, allowing the drying air to exit the distal end of the drying hose 16 and into the boot, shoe, or the like. As illustrated, the drying hose is hollow for allowing air to flow therethrough with a relatively constant diameter. The bends within the drying hose 16 are rounded for allowing smoother air flow through the turns of the drying hose 16 while in use.

The drying manifolds 14 contribute to the modular design of the device 10 and are designed to allow a second drying manifold 14' to be engaged to the second end of the drying manifold 14. As illustrated in FIG. 2, a first end of the second drying manifold 14' is engaged to a second end of a first drying manifold 14 in much the same way as the first drying manifold 14 is engaged to the distributing manifold 13. The second drying manifold 14' has a first end, a second end, and at least one opening disposed between the first end and the second end. An end cap 17 is disposed on the second end of the second drying manifold 14', as shown in FIGS. 1 and 2. Alternatively, a third, fourth, fifth, etc. drying manifold may be engaged to the adjacent drying manifold as desired by a user. The end cap 17 would be disposed on the second end of the last drying manifold 14, whether the device 10 has one drying manifold 14 on either side of the distributing manifold 13 or two or more drying manifolds (14, 14', etc.) on either side of the distributing manifold 13.

Figure 3:
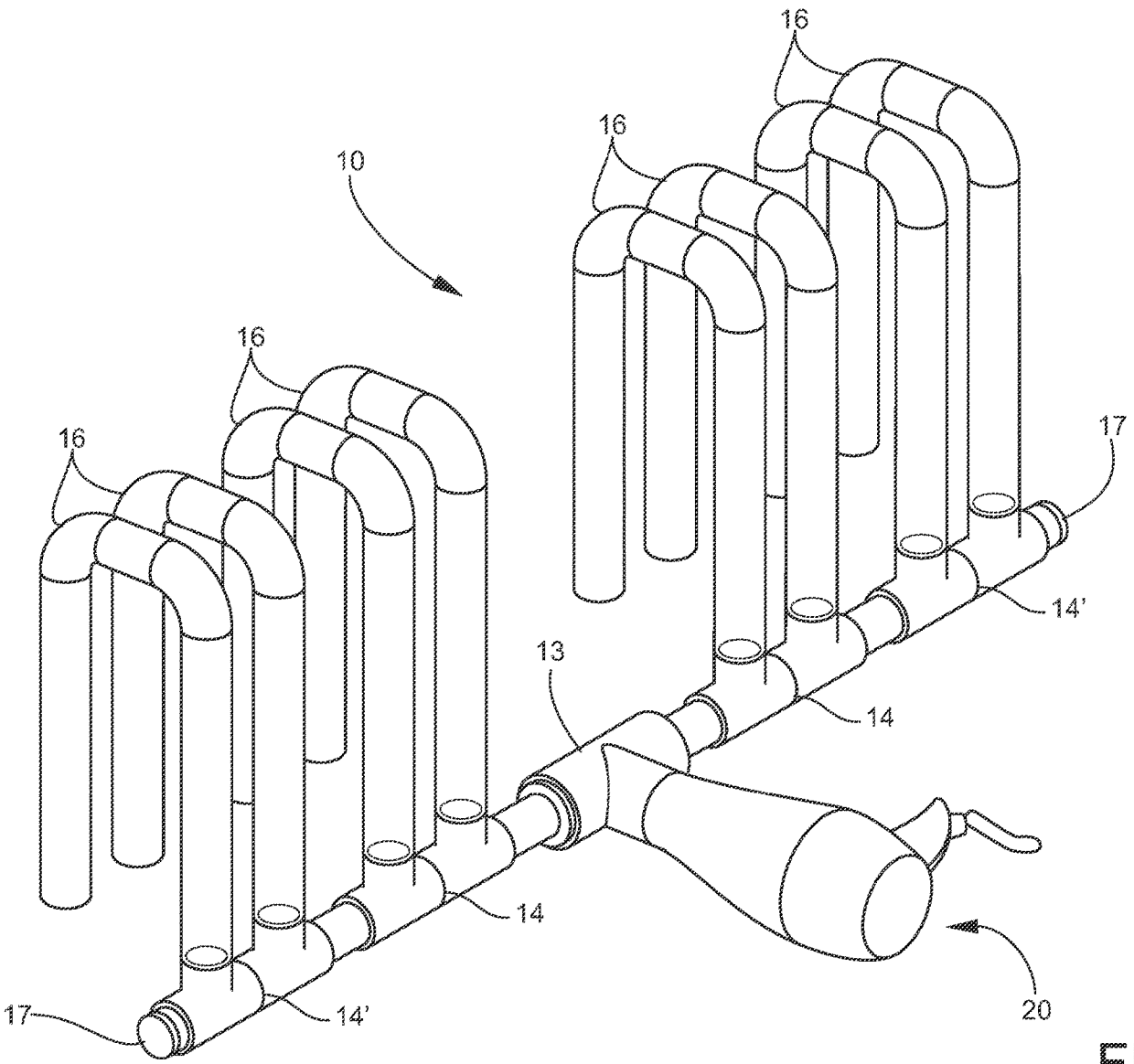
FIG. 3 is a perspective view of an alternative embodiment of a portable modular drying device.

An alternative embodiment of the device 10 is illustrated in FIG. 3. In this embodiment the blower device 20 is a hair dryer. As shown, the hair dryer is selectively secured to the distributing manifold 13 with the nozzle of the hair dryer inserted into the inlet of the distributing manifold. The hair dryer is selectively secured through a friction fit, and alternatively, an o-ring may be added to the nozzle of the hair dryer for providing a substantially air-tight friction fit.

Figure 4:
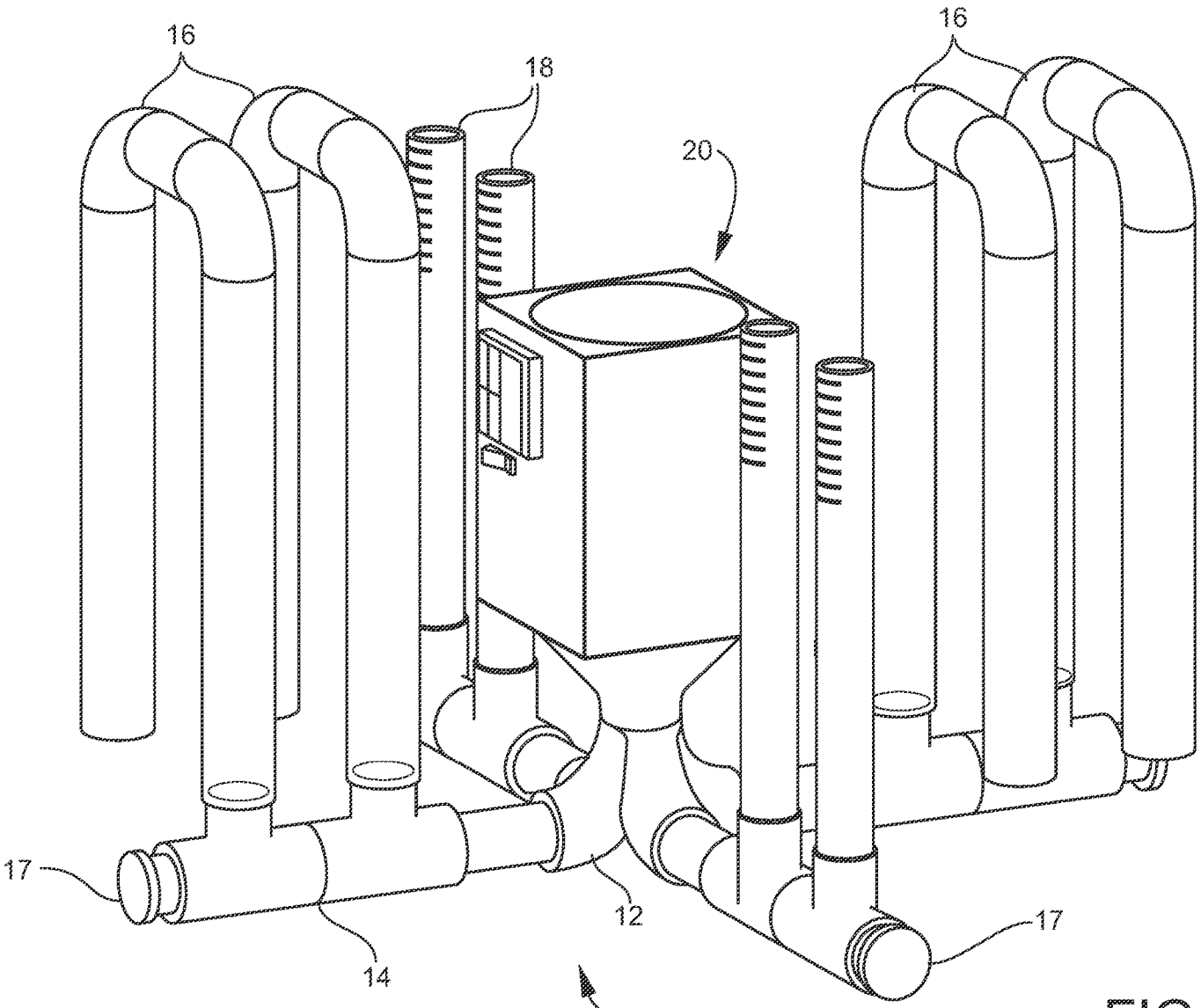
FIG. 4 is a perspective view of another alternative embodiment of a portable modular drying device.
Figure 5:
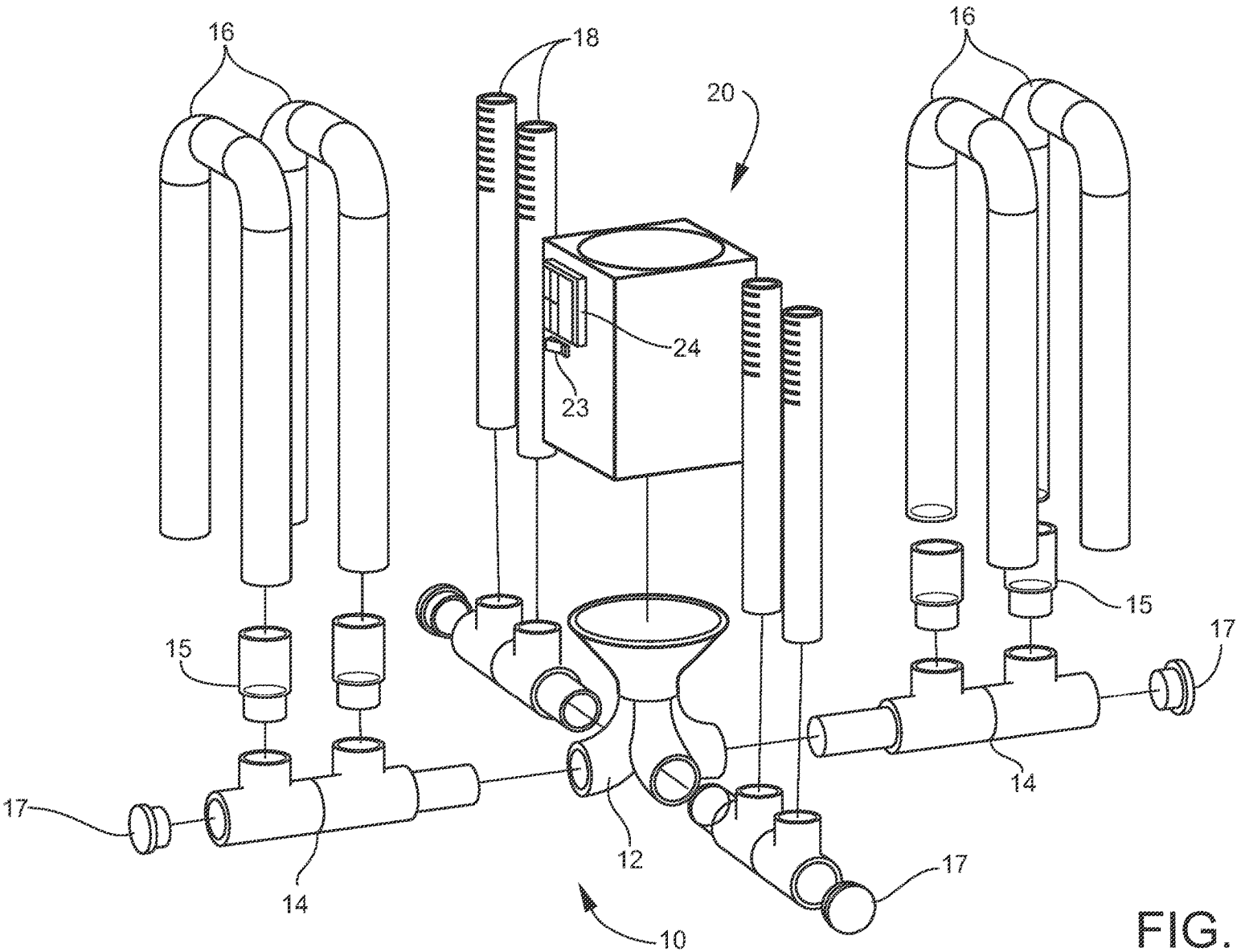
FIG. 5 is an exploded view of the portable modular drying device as shown in FIG. 4.

Yet another alternative embodiment of the device 10 is illustrated in FIGS. 4 and 5. In this embodiment, the distributing manifold 13 has more than two outlets. As shown, the distributing manifold 13 has one inlet engaged to the blower device, optionally disposed above the distributing manifold 13, and four outlets. Each outlet is selectively secured to the first end of a drying manifold 14. As mentioned above, subsequent drying manifolds 14 may be selectively secured to the drying manifold 14 engaged to the distributing manifold 13, depending upon the desires of the user. Instead of a drying hose 16 engaging an opening in the drying manifold 14, a drying conduit 18 may be engaged thereto. The drying conduit 18 includes a hollow shaft extending generally upwards from the opening in the drying manifold 14 having a first end and a second end. The first end is engaged to the drying manifold 14 and the second end extends upwards into the air. Drying air is fed into the drying conduit 18 from the drying manifold 14 and exits through the second end. A plurality of openings, such as slits, holes, are positioned on the sides of the drying conduit 18 in close proximity to the second end for allowing drying air to exit the openings. A glove, hat, or other clothing article is placed over the second end and the drying air exiting the second end and the openings of the drying conduit 18 dry the article.

Figure 6:
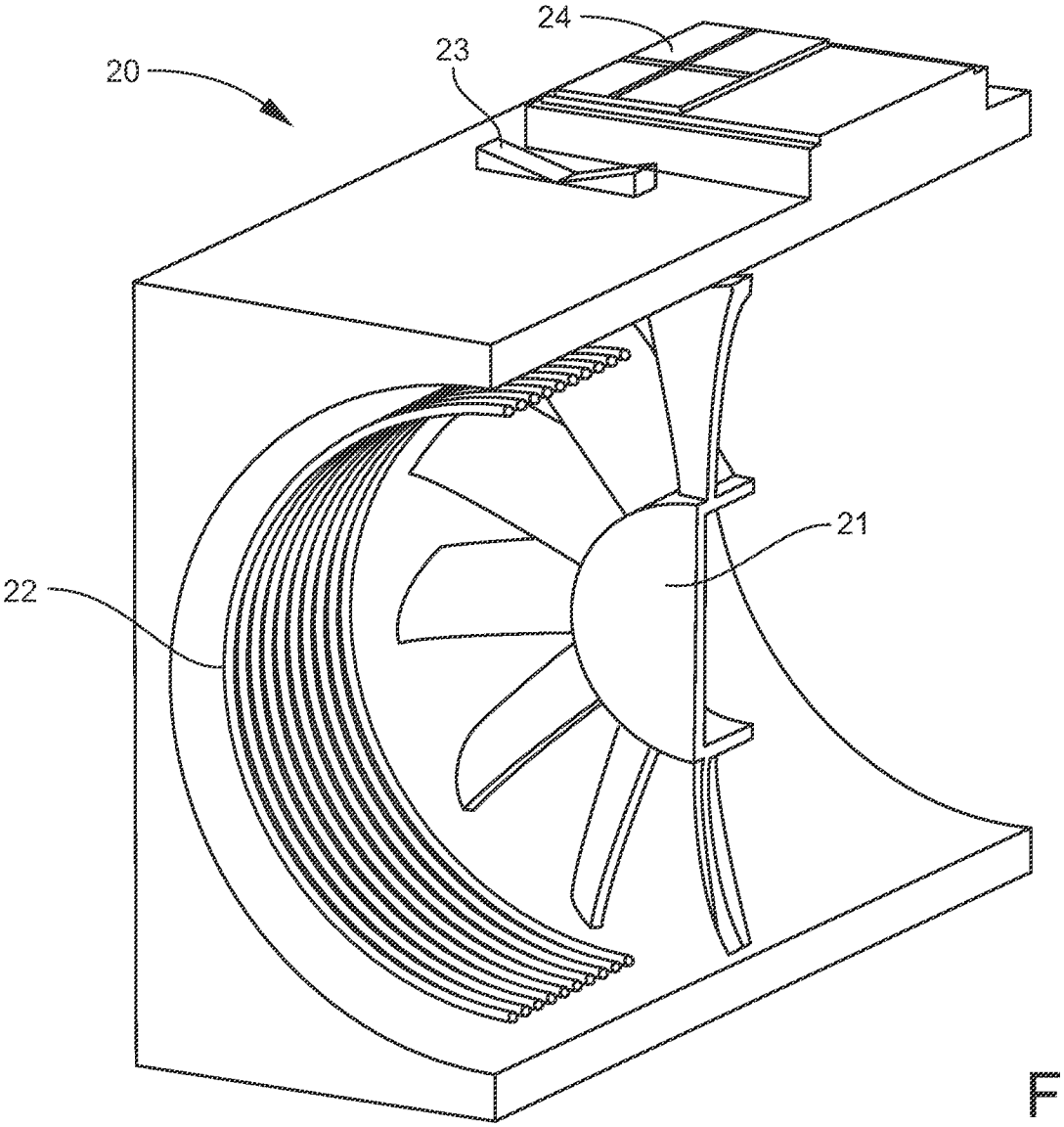
FIG. 6 is a cut-away, cross-sectional view of a blower in accordance with the present invention.

An optional blower device 20 is illustrated in FIG. 6. The blower device 20 is designed to force heated or non-heated drying air through the device 10. The blower device 20 contains a housing with a top side, a bottom side, a left side, a right side, a front side, and a back side. A motor (not shown) is positioned within the housing and drives a fan 21 for forcing the drying air through the front side of the housing. A power supply is engaged to the blower device 20 for providing the requisite power to the components. For heated air, a heating element 22 may be disposed within the housing on the external side of the fan 21 for heating the drying air. A switch 23, such as a rocker switch as shown, controls the power to the heating element and turns the heating element 22 to the "on position" and "off position." A timer element may be incorporated that either turns off the power supply, or alternatively, turns the heating element to the "off position" after a predetermined time period. It should be noted any other type of switch may be utilized by the user for turning the heating elements to the "on position" and "off position." A controller 24 may be mounted to the housing for controlling elements of the blower device 20. For example, the controller 24 may be set to operate the fan 21 for a predetermined amount of time. Optionally, the controller 24 may be set to operate the heating element 22 at a pre-set time and for a predetermined amount of time. A safety mechanism may be built into the controller 24 that automatically shuts off the heating element 22 and/or fan 21 after a predetermined amount of time.

The first end of the drying manifold 14 is engaged to the distributing manifold 13 by friction fit. As illustrated in FIGS. 1 and 2, the first end of the drying manifold 14 has a diameter slightly less than the diameter of the exit of the distributing manifold 13, allowing the drying manifold 14 to be inserted into the distributing manifold 13 and retained therein by friction fit. An optional o-ring may be inserted onto the first end of the drying manifold 14 for providing a secure and substantially air-tight engagement between the drying manifold 14 and distributing manifold 13. Likewise, the drying manifolds 14, 14' are engaged to one another by friction fit in one alternative embodiment. The diameter of the first end of the second drying manifold 14' is slightly less than the diameter of the second end of the first drying manifold 14, allowing the second drying manifold 14' to be inserted into the first drying manifold 14 and retained therein by friction fit. An optional o-ring may be inserted onto the first end of the second drying manifold 14' for providing a secure and substantially air-tight engagement.

In another alternative embodiment, the drying manifold 14 may be screwed into the distributing manifold 13 forming a selectively secured arrangement. In this embodiment, the first end of the drying manifold 14 has external threads corresponding to internal threads on the exit of the distributing manifold 13. Likewise, the first end of the second manifold 14' has external threads corresponding to internal threads on the second end of the first manifold 14.

Figure 7A:
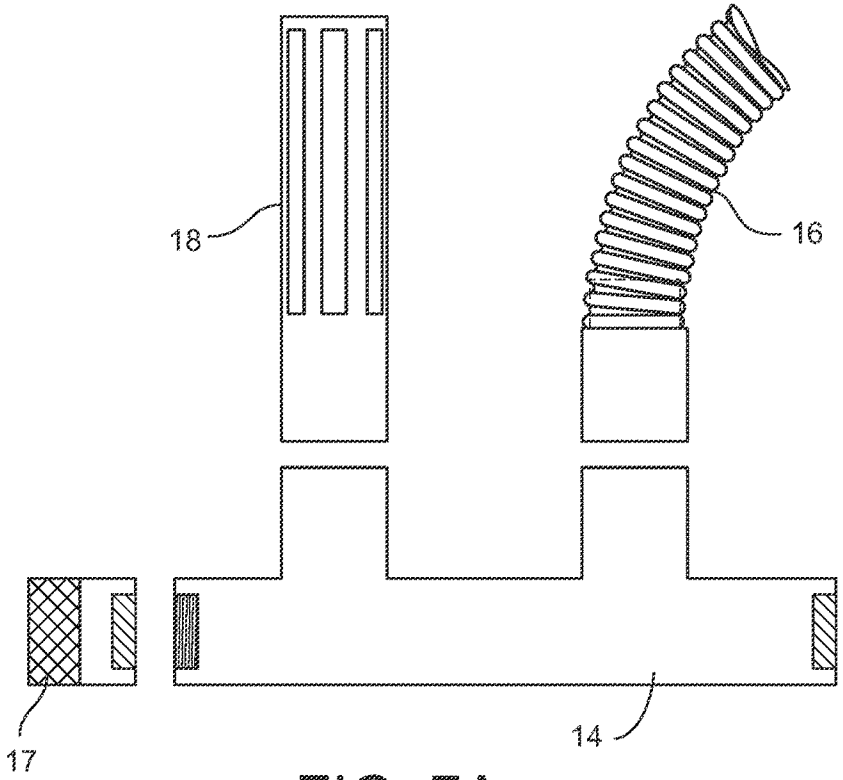
FIG. 7*a* is an exploded view of another alternative embodiment of a portable modular drying device.
Figure 7B:
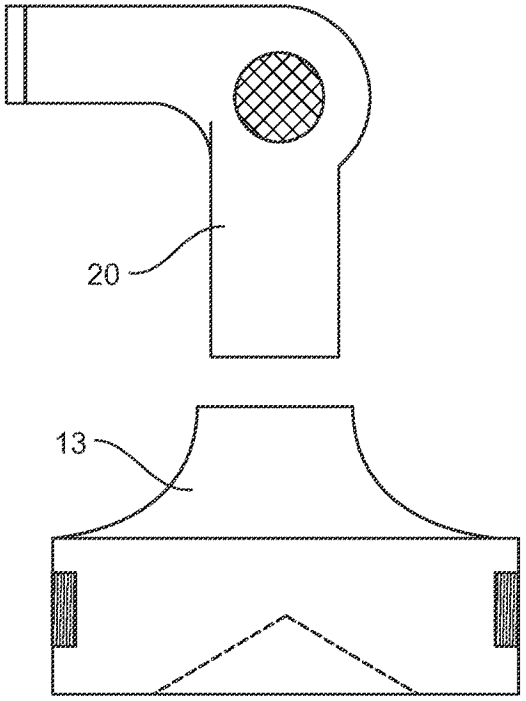
FIG. 7*b* is a side-view of a blower device being inserted into the distributing manifold having two female locking ends.
Figure 7C:
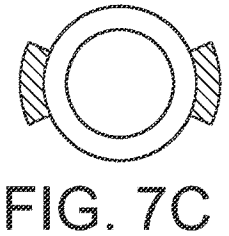
FIG. 7*c* is a top view of a male portion end.
Figure 7D:
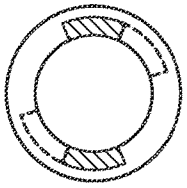
FIG. 7*d* is a top view of a female portion end.
Figure 7E:
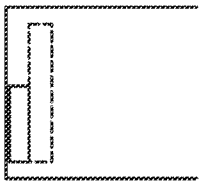
FIG. 7*e* is a side-view of a female portion end.

FIGS. 7*a*, 7*b*, 7*c*, 7*d*, and 7*e* show yet another embodiment of components of the device 10 including locking mechanisms. As illustrated in FIG. 7*a*, the drying conduit 19 contains longitudinal slots disposed on the conduit and running generally from the first end to the second end. The end cap 17 may optionally contain a knurled friction band on its distal end for increasing the friction force when a user desires to turn the end cap 17 for forming a selectively secured arrangement with the drying manifold 14. The end cap 17, drying manifold 14, and distributing manifold 13 may be selectively secured to one another through the use of corresponding male and female end portions. As illustrated in FIG. 7*c*, the male end portion comprises at least two, spaced-apart flanges extending outwardly from the side wall of end cap 17 and drying manifold 14. As illustrated in FIGS. 7*b*, 7*d* and 7*e*, the female end portion contains two spaced-apart channels within the side of the end of the drying manifold 14 and distributing manifold 13. The channels have an open area and a closed area, wherein the flanges of the male end portion are inserted into the open area of the channels of the female end portion. Thereafter, a slight turn causing the flanges of the male end portion to move in the clockwise direction, rotates the flanges from the open area to the closed area of the channels on the female end portion, thus selectively securing the male end portion to the female end portion. A slight turn in the counter-clockwise direction rotates the flanges from the closed area to the open area of the channel of the female end portion, allowing the male end portion to be separated from the female end portion.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A portable modular drying device, comprising: a blower device comprising:

a housing with a top side, a bottom side, a left side, a right side, a front side, and a back side;

a fan positioned within the housing for forcing drying air through the front side of the housing; and a heating element disposed within the housing on an external side of the fan for heating the drying air;

a distributing manifold for receiving a blower device;

at least one drying manifold having a first end, a second end, and two spaced-apart openings between the first end and second end for distributing the drying air, the drying manifold is selectively secured to the distributing manifold; at least one drying hose having a proximal end and a distal end, the proximal end of the drying hose is selectively secured to an opening of the drying manifold; and a hose adapter that is hollow and generally circular, the hose adaptor has a first end and a second end, wherein the second end has a diameter that is smaller than the first end, the entire second end is received within an opening of the drying manifold and the entire first end is received within the proximal end of the drying hose, wherein the proximal end of the drying hose contacts the drying manifold.

2. The portable modular drying device according to claim 1, further comprising a blower nozzle having a first side and a second side, wherein the first side is engaged to a blower device and the second side is engaged to the distributing manifold, the blower nozzle forms a direct communication between the blower device and the distributing manifold, and a controller for controlling the blower device.

3. The portable modular drying device according to claim 1, further comprising a switch for operating the heating element.

4. The portable modular drying device according to claim 1, further comprising a blower nozzle having a first end and a second end, wherein the first end has a diameter larger than the second end and the diameter of the first end gradually decreases.

5. The portable modular drying device according to claim 1, further comprising an end cap selectively secured to the second end of the at least one drying manifold.

6. The portable modular drying device according to claim 1, further comprising at least one hose adaptor selectively secured to the at least one opening of the at least one drying manifold and the at least one drying hose.

7. A kit for drying comprising: a distributing manifold for receiving a blower device; a first, second, third, and fourth drying manifold having a first end, a second end, and two spaced-apart openings between the first end and the second end for distributing the drying air, the first end of the first drying manifold and the third drying manifold are selectively secured to the distributing manifold, the second end of the first drying manifold is engaged the first end of the third drying manifold and the second end of the third drying manifold is engaged to the first end of the fourth drying manifold;

at least one drying hose having a proximal end and a distal end, the proximal end of the drying hose is selectively secured to an opening of one of the drying manifolds;

at least one hose adaptor that is hollow and circular in shape and having a first end and a second end, wherein the diameter of the first end is greater than the diameter of the second end and the entire second end is received within each opening of the first, second, third, and fourth drying manifolds and the entire first end is received within the proximal end of the drying hose, wherein the proximal end of the drying hose contacts the drying manifold;

and a first cap is engaged to the second end of the second drying manifold and a second cap is engaged to the second end of the fourth drying manifold.

8. The kit for drying according to claim 7, further comprising a blower nozzle having an entrance and a second end, wherein the entrance of the blower nozzle is engaged to the blower device and the second end of the blower nozzle is engaged to the distributing manifold and the entrance of the blower nozzle has a gradual decline in diameter, the blower nozzle forms a direct communication between the blower device and the distributing manifold.

9. The kit for drying according to claim 7, further comprising a blower device.

10. The kit for drying according to claim 7, further comprising at least one drying conduit.

11. The kit for drying according to claim 7, further comprising a blower nozzle having a first side and a second side, wherein the first side is engaged to a blower device and the second side is engaged to the distributing manifold.

12. The kit for drying according to claim 7, wherein the first end of the drying manifold has a diameter slightly smaller than the diameter of the second end.

13. A method for drying an article of clothing using a modular drying device, comprising: providing a modular drying device comprising a blower device having an outlet, a blower nozzle having an entrance and a second end wherein the entrance of the blower nozzle has a gradual decline in diameter, a distributing manifold having an inlet and a first exit and a second exit, the inlet of the distributing manifold is engaged to the second end of the blower nozzle, at least two drying manifolds having a first portion, a second portion, and a third portion, a first end and a second end are contained on the first portion, the second portion and the third portion consist of an elongate hollow tube that extends upwardly from the first portion, a first opening is contained on the second portion and a second opening is contained on the third portion for allowing a portion of the air traveling through the first end to exit through the first opening in the second portion and the second opening in the third portion, and drying hoses selectively secured to the first opening and the second opening of the drying manifolds;

a blower device attached to the blower nozzle, wherein the blower nozzle is in direct communication between the outlet of the blower device and the inlet of the distributing manifold; blowing drying air from the blower device into the blower nozzle and through the blower nozzle and into the inlet of the distributing manifold;

passing the drying air through the distributing nozzle and out the first exit and the second exit wherein the drying air enters the first end of the drying manifolds engaged to the first exit and the second exit of the distributing manifold with a portion of the drying air exiting the first openings and the second openings in the drying manifold; a hose adapter that is hollow and generally circular, the hose adaptor has a first end and a second end, wherein the second end has a diameter that is smaller than the first end, the entire second end is received within an opening of the drying manifold and the entire first end is received within the proximal end of the drying hose, wherein the proximal end of the drying hose contacts the drying manifold; and attaching an article of clothing to the drying hoses for drying the article of clothing.

14. The method of drying of claim 13, wherein the second portion and the third portion of the drying manifold extend at an angle of about 90 degrees relative to the first portion of the drying manifold.

15. The method of drying of claim 13, wherein the at least one drying hose has a proximal end and a distal end, the proximal end of the drying hose is selectively secured to either the first opening or the second opening of the drying manifold.

* * * * *